United States Patent [19]

Yamada

[11] Patent Number: 4,518,181

[45] Date of Patent: May 21, 1985

[54] LOCKING DEVICE

[75] Inventor: Shinjiro Yamada, Tokyo, Japan

[73] Assignee: Mitsui Kinzoku Kogyo Kabushiki Kaisha, Tokyo, Japan

[21] Appl. No.: 497,711

[22] Filed: May 24, 1983

[30] Foreign Application Priority Data

May 28, 1982 [JP] Japan ..... 57-90955
Dec. 14, 1982 [JP] Japan ..... 57-218739

[51] Int. Cl.[3] ..... E05C 3/26
[52] U.S. Cl. ..... 292/201
[58] Field of Search ..... 292/144, 201, 216; 70/277; 74/57

[56] References Cited

U.S. PATENT DOCUMENTS

| | | | |
|---|---|---|---|
| 950,551 | 3/1910 | Ledoux . | |
| 2,824,582 | 2/1958 | Reitherman | 74/57 X |
| 2,898,138 | 8/1959 | Van Noord | 292/201 X |
| 3,566,703 | 3/1971 | Van Noord | 292/201 X |

*Primary Examiner*—Richard E. Moore

*Attorney, Agent, or Firm*—Stevens, Davis, Miller & Mosher

[57] ABSTRACT

A power-driven automobile door locking device of the type wherein a latch engages and arrests a striker on the door. The device has a lock lever capable of assuming a locking position in which the latch is not releasable and an unlocking position in which the latch is releasable. The lock lever is moved by a motor between the locking and unlocking positions. The motor drives a rotary disk in rotation, which disk has an essentially spiral cam groove in the surface thereof. A cam follower engages with the spiral cam groove, and, as the disk is rotated, the cam follower is caused to move radially of the disk, the radial movement of the cam follower is transmitted to the lock lever through any suitable mechanism. The spiral groove operates to transmit an amplified force to the cam follower. The rotary disk may be replaced by a rotary cylinder having a cam groove in its cylindrical surface. A modified cam groove is defined by an action-imparting or camming side edge and a non-action-imparting or non-camming side edge, and the groove has the greatest width at its mid-portion.

11 Claims, 31 Drawing Figures

LOCKING DEVICE

BACKGROUND OF THE INVENTION

The present invention relates to a locking device and, more particularly, to a locking device especially adapted for locking a door of an automobile.

In conventional motor-driven automobile door locking devices, a lock lever is disposed within the main body of a locking device and operatively coupled to a power source or a motor so that the lock lever is moved or rotated between an unlocking position in which the latching mechanism within the locking device can be released and a locking position in which the latching mechanism cannot be released. That is, the output of the motor is transmitted through a transmission mechanism, such as a mechanism including a pinion and a sector gear, to the lock lever. Such a driving mechanism of the type described above is incapable of producing a driving force beyond a certain limit so that when a greater driving force is needed, a motor with a higher output must be used.

In the conventional automobile door locking device, in order to hold the lock lever in the locking position or in the unlocking position, the so-called over-center spring is used which can bias the lock lever in either direction when the lock lever has passed past a dead center point. The over-center spring has a relatively strong force so that, in order to rotate the lock lever, a force which is greater than the force of the over-center spring must be applied to the lock lever. Therefore, there is a problem in that the power source or the motor must have a high output power.

SUMMARY OF THE INVENTION

In view of the above, one of the objects of the present invention is to provide a locking device in which the output of a driving device or a motor can be remarkably amplified by utilizing a kind of wedge action and transmitted to a lock member such as a lock lever, whereby a driving device or motor which has a small output and is compact in size and light in weight can be advantageously used.

According to the present invention, a power mechanism for driving a lock member is operatively coupled to a rotary member. A cam is disposed around the center of rotation of the rotary member in such a manner that the two ends of the cam are spaced apart radially or axially by a suitable distance. A cam follower is slidably engaged with the cam and is operatively connected to the lock member. Therefore, as the rotary member is driven in rotation, the cam follower is caused to move radially or axially by the above mentioned suitable distance, thereby causing the lock member to move between locking and unlocking positions thereof.

More specifically, according to the present invention, a force amplification mechanism including the rotary member and based on the wedge action principle is incorporated into a mechanism for switching the lock member between the locking and unlocking positions so that the power required for driving the lock member can be considerably reduced. In addition, the manual operation for switching the lock member between the locking and unlocking positions can be carried out without causing any adverse effect on the power driving mechanism.

The nature, utility, and further features of this invention will be more clearly apparent from the following detailed description with respect to preferred embodiments thereof when read in conjunction with the accompanying drawings, briefly described below.

DESCRIPTION OF THE PREFERRED EMBODIMENTS

Figure 1:
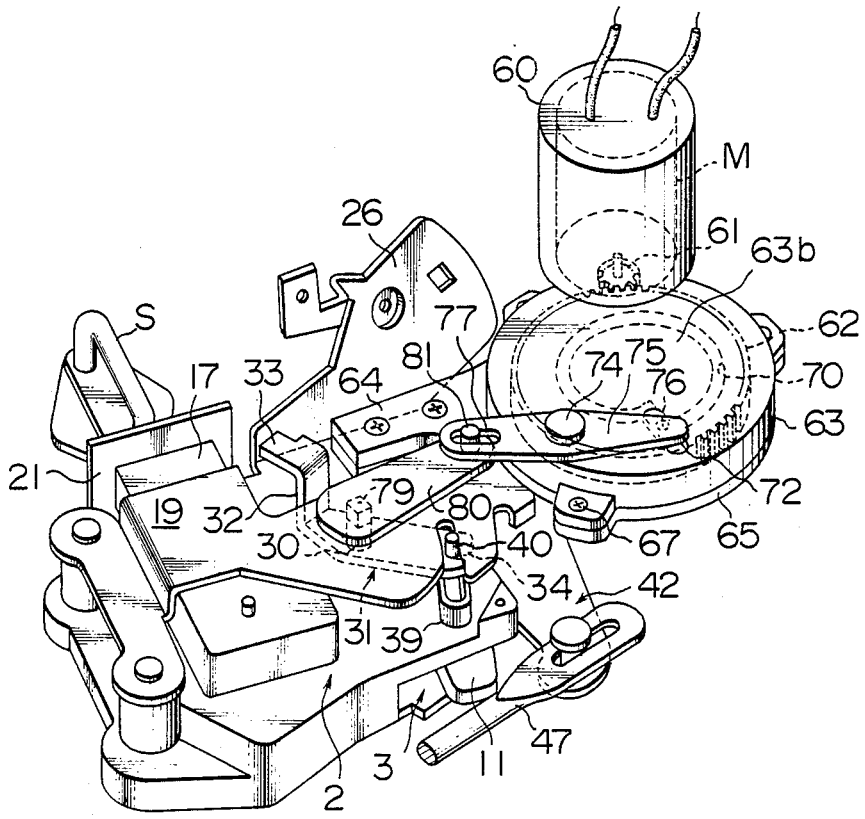
FIG. 1 is a perspective view of a first embodiment of the present invention.

In FIG. 1 is shown a first example of the locking device, adapted for use with a door of an automobile, in accordance with the present invention, having a main body comprising a base member 2 (See FIG. 4) made of, for instance, a synthetic resin and a cover plate 3 (See FIG. 3) attached to the back surface (as viewed in FIG. 1) of the base member 2. The base member 2 has a hollow space in which is housed a conventional latching mechanism to be described later, and supports thereon a mechanism for controlling the latching mechanism. The base member 2 is made structurally integral with the cover plate 3 with rivets or the like and is securely fixed to a side door of an automotive vehicle in a conventional manner when the locking device is used to lock the side door.

Figure 3:
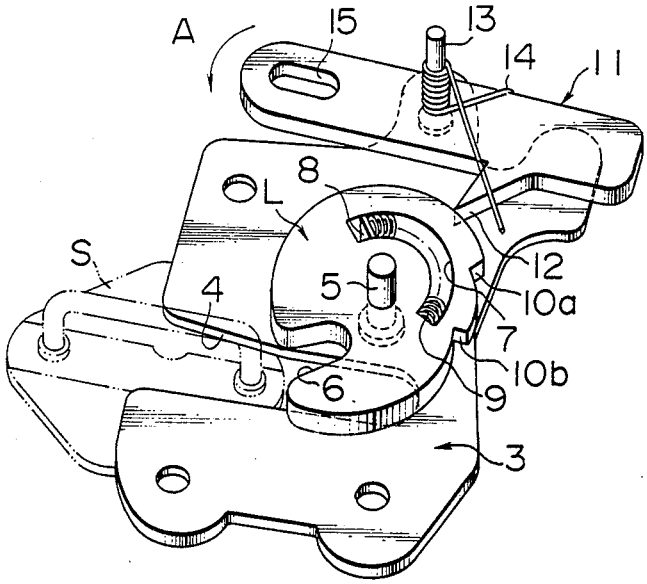
FIG. 3 is a perspective view of a cover plate and its associated parts.

As best shown in FIG. 3, the cover plate 3 is formed with a guide slot 4 into and out of which a striker S secured to the vehicle body is slidable. A latch L is rotatably supported by a shaft 5 on the cover plate 3 and is extended across the guide slot 4. As is well known in the art, the latch L is formed with a recess 6 adapted to engage with the striker S. The latch L is formed with an arcuate slot 7 whose center coincides with the axis of the shaft 5 and a projection 8 struck out of the cover plate 3 is fitted in the arcuate slot 7. A compression spring 9 is loaded between one end of the arcuate slot 7 and the projection 8 so that the latch L is normally biased in the clockwise direction as viewed in FIG. 3. The latch L has a half-latching notch 10*a* and a full-latching notch 10*b* formed at the periphery thereof, and a ratchet 11 supported by a shaft 13 is engageable with either the notch 10*a* or 10*b*. The ratchet 11 is so biased by a spring 14 that the engaging pawl 12 of the ratchet 11 is normally pressed against the periphery of the latch L. The ratchet 11 is formed with an elongated slot 15 adjacent to one end thereof.

Still referring to FIG. 3, when the striker S moves into the guide slot 4 of the cover plate 3 and then into the recess 6 of the latch L, the striker S pushes the latch in the counterclockwise direction so that the engaging pawl 12 first engages with the half-latching notch 10*a* and then with the full-latching notch 10*b*, whereby the ratchet 11 is brought into complete engagement with the latch L. In order to release the ratchet 11 from the latch L, the ratchet 11 is moved in the direction indicated by the arrow A so that the engaging pawl 12 is released from the full-latching notch 10*b*.

Figure 4:
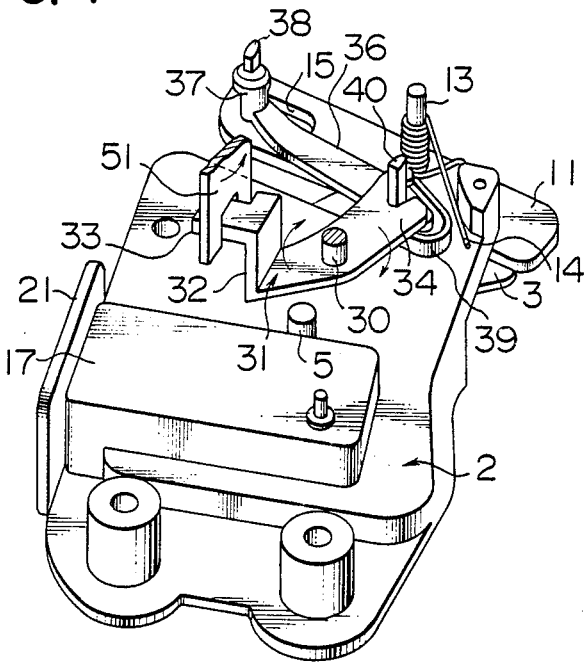
FIG. 4 is a perspective view of a base member and its associated parts.

The base member 2 which covers the cover plate 2 supporting the latch L and the ratchet 11 has a hollow ridge portion 17 which covers the guide slot 4 for the striker S as shown in FIG. 4. The ridge portion 17 has a flange 21. The shaft 5 of the latch L is extended beyond the upper surface of the base member 2.

Referring back to FIG. 1, a metal plate member 19 is attached on the base member 2. The metal member 19 has an upright wall 26 along one side thereof. The metal member 19 has a hole (not shown) through which is passed the shaft 5 and another hole (not shown) through which is extended a shaft 30 (See FIG. 4) which in turn carries a lock lever 31 (See FIG. 4). The lock lever 31 has an upright portion 32 extended upwardly from one end thereof, and an engaging portion or projection 33 is extended from the upper end of the upright portion 32. The other end of the lock lever 31 is bifurcated as indicated at 34.

As shown in FIG. 4, one end 37 of a connecting link 36 is engaged with the elongated slot 15 of the ratchet 11. That is, a pin (not shown) is extended from the one end 37 of the link 36 into the elongated slot 15. An upright projection 38 is extended upwardly from the one end 37 of the link 36. The other end of the link 36 is slidably fitted into a guide channel 39 formed integral with the base member 2, and a pin 40 is extended upwardly from the other end of the link 36. The pin 40 is in engagement with the bifurcated end 34 of the lock lever 31. Therefore, when force is exerted on the engaging projection 33 of the lock lever 31 so as to cause the lever 31 to rotate about the shaft 30, the bifurcated end 34 which engages with the pin 40 causes the pin 40 and hence the connecting link 36 to be displaced in its longitudinal direction. This displacement of the connecting link 36 is limited by the length of the elongated slot 15 into which is fitted one end 37 of the connecting link 36.

Figure 2:
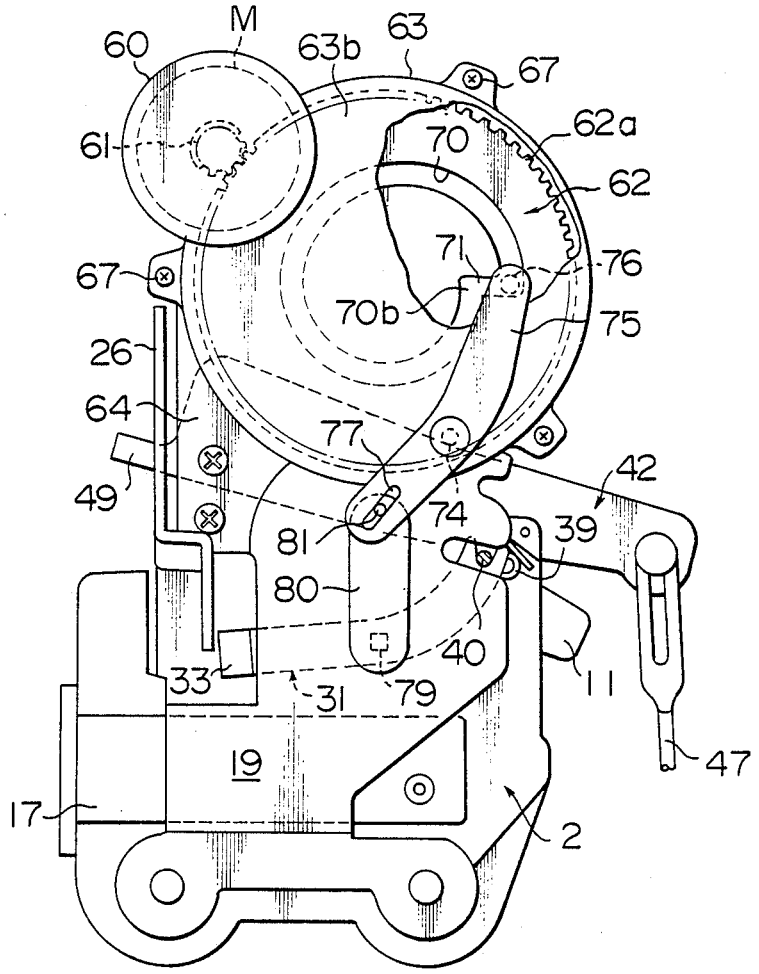
FIG. 2 is a top view thereof.
Figure 5:
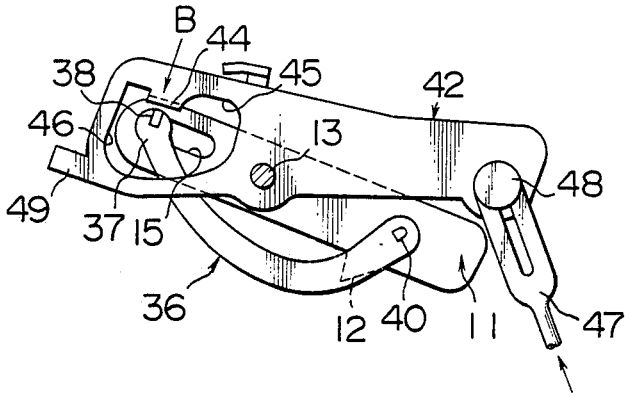
FIG. 5 is a top view showing a release lever, a connecting link and a ratchet.

Referring to FIGS. 2 and 5, a release lever 42 is rotatably carried by the shaft 13 behind the metal member 19 and is interposed between the ratchet 11 and the metal member 19. The release lever 42 is normally biased in the clockwise direction as viewed in FIG. 1 by a bias spring (not shown) loaded around the shaft 13.

As best shown in FIG. 5, the release lever 42 is formed adjacent to one end thereof with an opening 46 which in turn has a projection 44 adapted to engage with the projection 38 of the connecting link 36 and a recessed portion 45. An operating link 47 which is connected to a handle outside of the vehicle door is connected by means of a pin 48 to the other end of the release lever 42. A projection 49 is extended from one end of the release lever and is coupled to a conventional rotary lever (not shown) which is operated by the inner door handle (not shown). As is well known in the art, the rotary lever is pivotably fixed to the upright wall 26 of the metal member 19.

When the locking device is in its normal position, the connecting link 36 is located at the position as shown in FIG. 5, and the projections 38 and 44 are in opposed relationship with each other. When the indoor or outdoor handle is so operated that the release lever 42 is rotated in the counterclockwise direction in FIG. 5, the projection 44 of the release lever 42 pushes the projection 38 in the direction indicated by the arrow B. As a result, the downwardly extended pin (not shown) which is integral with the projection 38 engages with the elongated slot 15 of the ratchet 11 so that the ratchet 11 is caused to move in the direction indicated by the arrow A in FIG. 3. Consequently, the latch L is released and the striker S is therefore released from the main body of the locking device.

Figure 6:
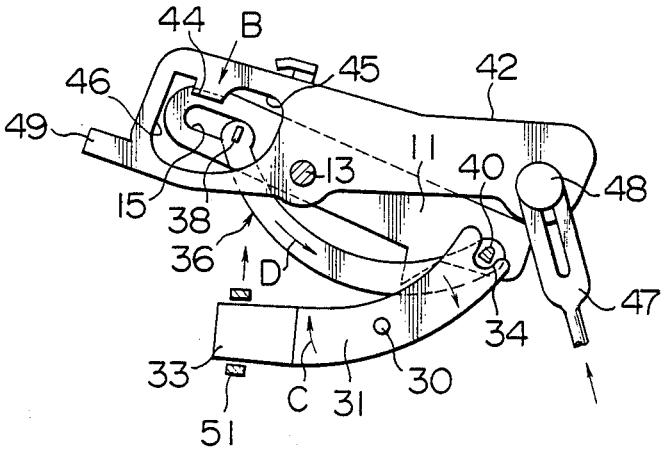
FIG. 6 is a top view showing the relationships among the relase lever, the connecting link and a lock lever.

In order to bring the locking device into the locking position, the lock lever 31 is rotated in the direction indicated by the arrow C in FIG. 6 by the action of a fork member 51, which is coupled to an operating device for locking and engaged with the projection 33 of the lock lever 31. As a result, the connecting link 36 is pulled in the direction indicated by the arrow D (See FIG. 6) so that the projection 38 at one end of the link 36 is displaced along the elongated slot 15 to assume the position as indicated in FIG. 6. When the release lever 42 is rotated in the counterclockwise direction under these conditions so as to move its projection 44 in the direction indicated by the arrow B, the projection 44 will not engage with the projection 38 of the link 36. In addition, since the recessed portion 45 is provided, the release lever is prevented from engaging with the projection 38. As a consequence, the ratchet 11 remains unmoved; that is, the locking device remains in the locking position. To release the device from the locked state, the lock lever 31 is rotated in the opposite direction so that the connecting link 36 is returned to the position as shown in FIG. 5.

As described above, in order to move the locking device between the locking position and the unlocking position, the lock lever 31 is used. In the case of high-class car, the lock lever 31 is actuated by means of a solenoid or a motor which in turn is energized by the driver. Regardless how the lock lever 31 is actuated, the projection 38 of the connecting link 36 must be held at the locking position; that is, at one end of the elongated slot 15 as shown in FIG. 6 or at the unlocking position; that is, at the other end of the elongated slot 15 as shown in FIG. 5. The projection 38 therefore must not be held at an intermediate position between the both ends of the elongated slot 15. In the conventional locking devices, the lock lever 31, which causes the displacement of the connecting link 36, is so designed and constructed as to click between its two extreme positions, whereby it is prevented from being held at an intermediate position between the two extreme positions. To this end, the lock lever 31 is loaded with an overcenter spring having a relatively high spring force. Therefore, when the lock lever 31 has moved past the midpoint between its extreme ends (that is, the dead center point), it is caused to move toward and held at either of the two extreme positions under the snap action of the over-center spring. Therefore, it follows that a relatively great force is needed to cause the lock lever 31 to move past the dead point when the lever 31 is moved from its one extreme position to the other extreme position. As a result, a relatively high current must be supplied to a solenoid or a motor which causes the lock lever 31 to rotate. Since one locking device is provided for each door, the value of the current supplied is increased in proportion to the number of doors as described before.

According to the present invention, a mechanism capable of producing a wedge action is included in the driving mechanism so that the locking members such as the lock lever 31 may be driven with a relatively small force, and the need of providing an over-center spring in the power mechanism may be eliminated.

Referring back to FIGS. 1 and 2, a motor M, which is housed in a casing 60, drives the lock lever 31 between the locking and unlocking positions. The motor M is reversible and its output shaft carries a pinion 61 which in turn meshes with external teeth 62*a* of a rotary disk 62. The rotary disk 62 is housed within a short cylindrical casing 63 with a bottom and is rotatable about the axis of the casing 63. The casing 63 is mounted on and securely fixed to a supporting disk 65 with screws 67 which in turn is securely attached to the metal member 19 through an arm 64. It is preferable that the casings 60 and 63 be made of a synthetic resin and formed integral with each other.

Figure 7:
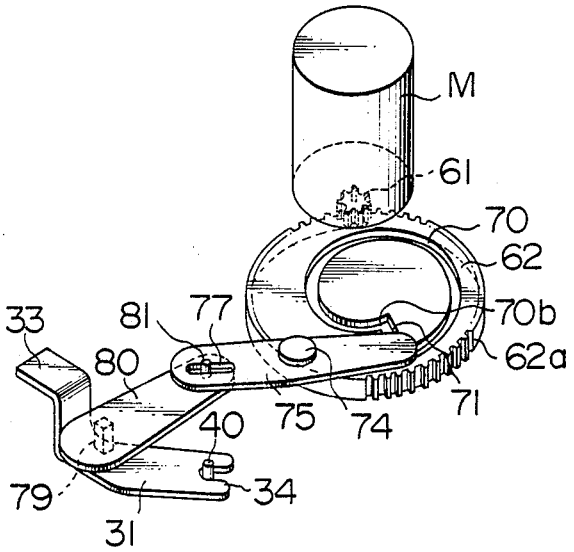
FIG. 7 is a perspective view showing the relationships among a rotary disk, a cam groove, a follower lever, an intermediate lever and the lock lever.
Figure 8:
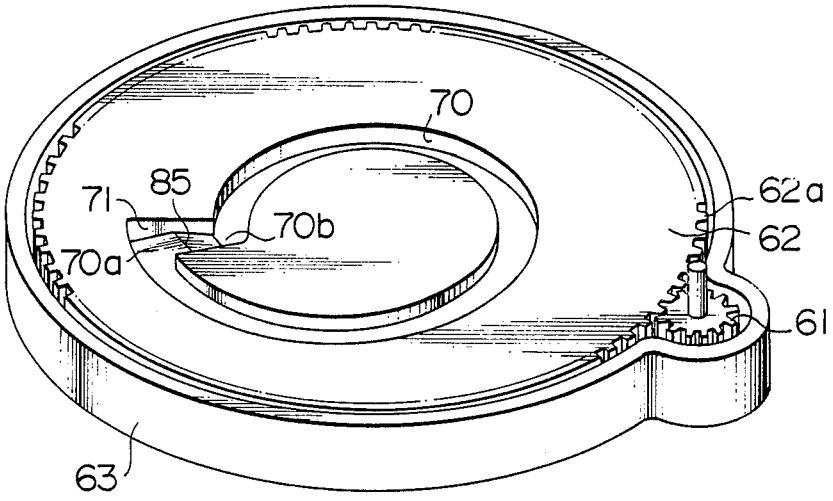
FIG. 8 is a detailed perspective view of the rotary disk.

As shown in FIGS. 7 and 8, the rotary disk 62 is formed with a cam groove 70 in the form of a spiral whose center coincides with the axis of the rotary disk 62. That is, the spiral groove 70 is extended from one end 70*a*, which is most remote from the axis of rotation of the rotary disk 62, to the other end 70*b* which is closest to the axis of rotation. The one end 70*a* and the other end 70*b* are spaced apart from each other in the radial direction of the rotary disk 62 and are in communication with each other through a radial groove 71. The cam groove 70 and the radial groove 71 thus define an endless groove.

The casing 63 has a cover plate 63*b* which covers the rotary disk 62 housed in the casing 63 (See FIGS. 1 or 2). The cover plate 63*b* is formed with an opening 72 (See FIG. 1) which is in opposed relationship with the radial groove 71 of the rotary disk 62. The midpoint of a follower lever 75 is pivoted with a pivot pin 74 to the cover plate 63*b*. A pin-shaped cam follower 76 is extended from one end of the follower lever 75 and is fitted into the cam groove 70 of the rotary disk 62. An elongated slot 77 is formed in the follower lever 75 adjacent to the other end thereof. One end of an intermediate lever 80 is connected to the lock lever 31 through a square shaft 79 which is in coaxial relationship with the shaft 30 of the lock lever 31. Therefore, the intermediate lever 80 and the lock lever 31 can move in unison with each other. A pin 81 is extended from the other end of the intermediate lever 80 and is fitted in the elongated slot 77 of the follower lever 75.

Figure 9:
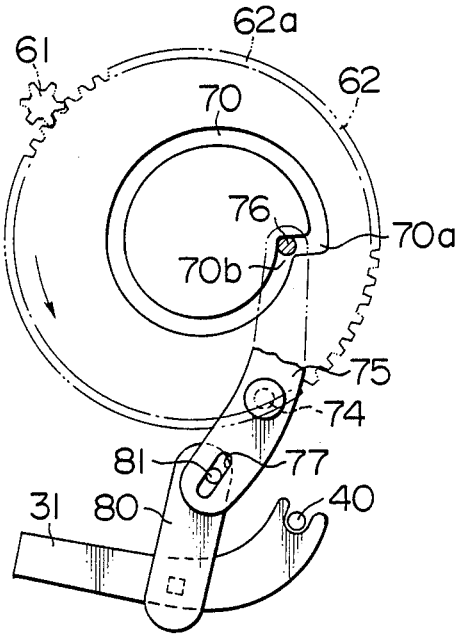
FIG. 9 and FIG. 10 are views explanatory of the locking and unlocking operations.
Figure 10:
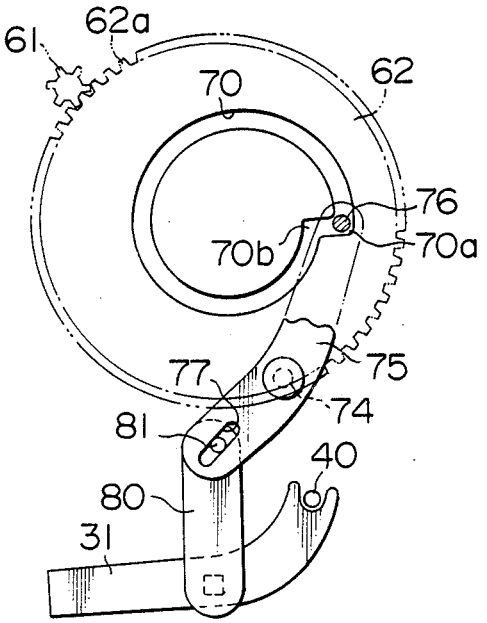

When the motor M is driven, the pinion 61 which is in mesh with the teeth of the rotary disk 62 rotates so that the rotary disk 62 is rotated in either direction. Then the cam follower 76 is caused to move radially inwardly or outwardly of the rotary disk 62 along the cam groove 70 so that the follower lever 75 is caused to rotate about its pivot pin 74. For instance, assume that the cam follower 76 is initially at the end 70*b* of the cam groove 70 and the rotary disk 62 is rotated in the counterclockwise direction as shown in FIG. 9. Then the cam follower 76 is first displaced radially outwardly to the position 70*a* in the cam groove 70 as shown in FIG. 10 while the follower lever 75 is caused to rotate about the pivot pin 74 in the clockwise direction. As described in detail with reference to FIG. 6, the lock lever 31 is held in the locking position in FIG. 9 while the lock lever 31 is held in the unlocking position in FIG. 10. It follows therefore that when the cam follower 76 is held in the position 70*b* of the cam groove 70, the locking device is in the locking position, while when the cam follower 76 is at the end 70*a* of the cam groove 70, the locking device is in the unlocking position.

In order to move the lock lever 31 between locking and unlocking positions, the motor M must cause the rotary disk 62 to rotate in either direction until the cam follower 76 reaches the end 70*a* or 70*b* of the cam groove. Therefore, it follows that when the rotary disk 62 is rotated in either direction, the lock lever 31 can be automatically brought to and held in the locking position or the unlocking position. Thus, the use of an over-center spring for bringing the lock lever 31 to and holding it in the locking or unlocking position can be eliminated in the case of the use of the motor M.

As described above, when the motor M is energized, the lock lever 31 is rotated to the locking position or the unlocking position. In the case of the manual operation, the force is exerted on the projection 33 of the lock lever 31 in a conventional manner. Then the follower lever 75 is caused to rotate through the intermediate lever 80 so that the cam follower 76 is caused to move radially from the end 70*a* to the end 70*b* of the cam groove 70 or from the end 70*b* to the end 70*a*, but the rotary disk 62 remains stationary. Thus the manual operation will not affect the power device. In order to cause the lock lever 31 to snap between the locking and unlocking positions, a conventional over-center spring may be provided. However, the transmission of the force from the rotary disk 62 to the cam follower 76 which is in engagement with the cam groove 70 of the rotary disk 62 is remarkably increased because of a wedge action to be described below, so that the output of the motor M for overcoming the force of the over-center spring may be considerably reduced as compared with the conventional locking devices.

Figure 11:
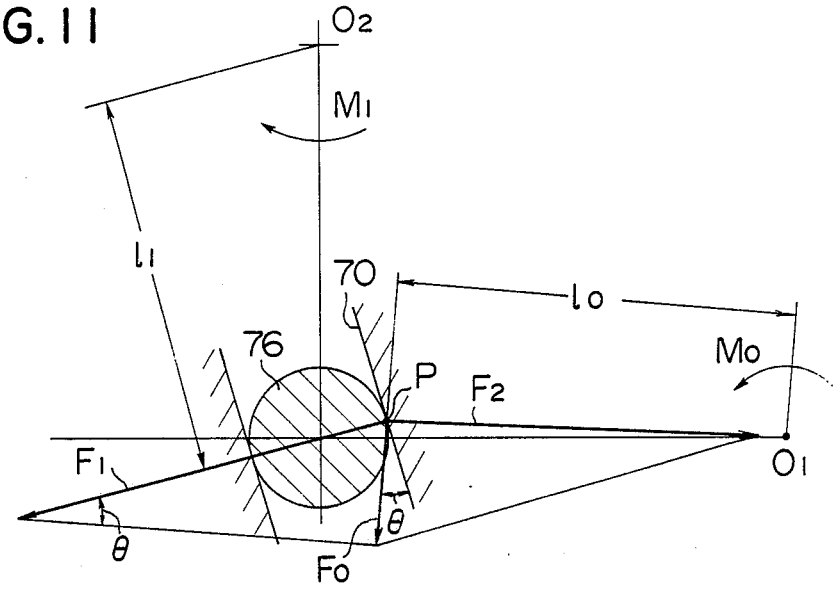
FIG. 11 is a diagram explanatory of the principle of the force amplification used in the present invention.

Referring next to FIG. 11, the wedge action on the cam follower 76 will be described in detail. The rotary disk 62 rotates about the axis $O_1$ and the cam follower 76 is fitted in the cam groove 70 which intersects a radius extended from the axis of rotation $O_1$ at an angle (except a right angle). The follower lever 75 which carries the cam follower 76 rotates about the axis $O_2$ of the pivot pin 74. When a torque Mo acts on the rotary disk 62, a force Fo acts on the cam follower 76 at the point P at which the cam follower 76 makes contact with the side wall of the cam groove 70. Let the distance between the axis $O_1$ and the point P be denoted by $1_1$. Then Fo=Mo/lo. This force Fo may be resolved into a component $F_1$ perpendicular to the side wall of the cam groove 70, that is, in the direction of a line connecting the point P and the center of the cam follower 76 and a component $F_2$. The first component $F_1$ is given by $$F_1 = Fo/\text{sine } \theta$$

where $\theta$ is the pressure angle at the point P. Since sin $\theta$ is smaller than 1, $F_1$ is greater than Fo ($F_1 > Fo$). Especially when the pressure angle $\theta$ is small, the component $F_1$ becomes far greater than the force Fo. It follows therefore that the cam follower 76 is subject to a considerably amplified force; that is, the component $F_1$. A considerably greater torque $M_1 = F_1 \cdot 1_1$, where $1_1$ is the distance of a perpendicular from the axis $O_2$ to the line of force $F_1$, is therefore exerted on the point $O_2$.

Figure 12:
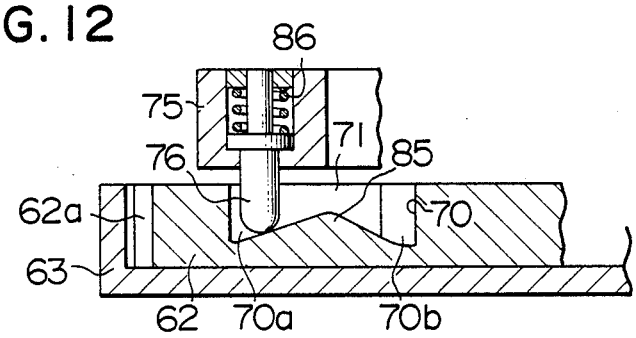
FIG. 12 is a sectional view showing the relationship between a radial cam groove and a cam follower.

In order to impart a snap action to the lock lever 31 in the case of the manual operation, a ridge or a snap-action producing portion 85 can be provided as shown in FIGS. 8 or 12 in the radial groove 71 of the rotary disk 62. In this case, a spring 86 is loaded in the follower lever 75 so that the cam follower 76 may be elastically retracted. Therefore, while moving along the radial groove 71, the cam follower 76 cannot remain stationary and is forced to move toward and held at the end 70*a* or 70*b* of the cam groove 70. As a result, the lock lever 31 is caused to snap between the locking and unlocking positions.

Figure 13:
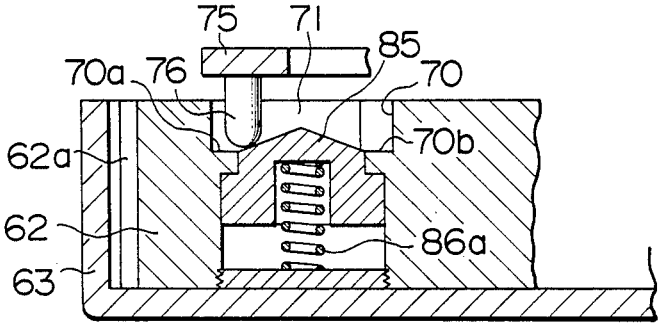
FIG. 13 is a sectional view of a modification of the radial cam groove and the cam follower shown in FIG. 12.

The arrangement as shown in FIG. 12 may be modified as shown in FIG. 13. That is, the cam follower 76 is securely attached to the follower lever 75, and the ridge or snap-action producing portion 85 is so designed and constructed as to be retracted or lowered into the rotary disk 62, a bias spring 86*a* being loaded between the ridge portion 85 and the rotary disk 62. Therefore, when the cam follower 76 passes through the radial groove 71, the ridge or snap-action producing portion 85 is retracted against the force of the bias spring 86*a*.

Figure 14:
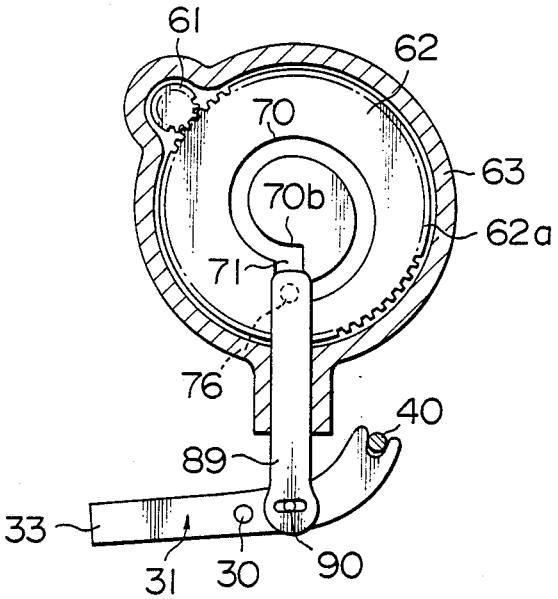
FIG. 14 shows a modification of the rotary disk and the lock lever.

In a modification as shown in FIG. 14, a follower lever 89 is in line with the radial groove 71, so that, as the rotary disk 62 rotates, the follower lever 89 is caused to slide radially inwardly or outwardly so that the lock lever 31 is rotated. The follower lever 89 has an elongated slot into which is fitted a pin 90 extended from the lock lever 31. Thus, in response to the radialy inward or outward displacement of the follower lever 89, the lock lever 31 is caused to swing about its shaft 30.

It is to be understood that the lock lever 31 and the cam follower 76 may be interconnected with each other by any other suitable means.

Figure 15:
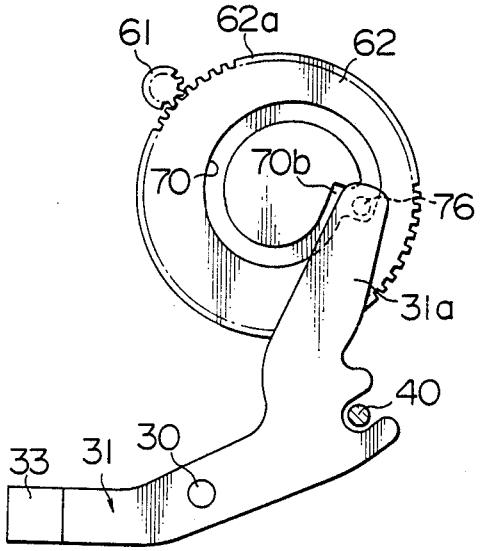
FIG. 15 shows another modification in which the cam follower is directly carried by the lock lever.

In FIG. 15 the cam follower 76 is shown as being directly attached to the lock lever 31. That is, the lock lever 31 is formed with an extended arm 31*a* and the cam follower 76 is carried at the free end of the arm 31*a*.

Figure 16:
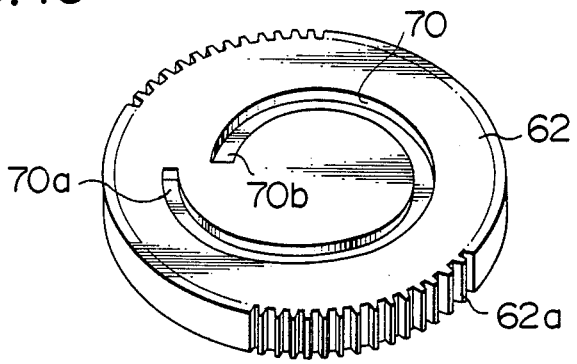
FIGS. 16, 17 and 18 show modifications of the rotary disk.
Figure 17:
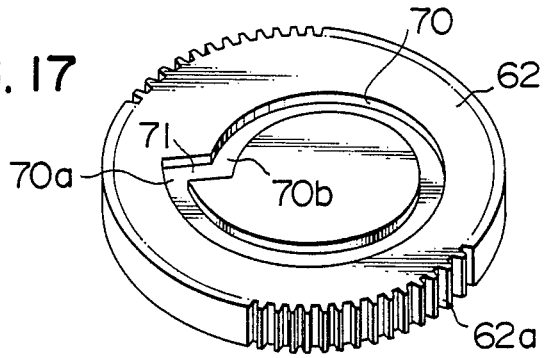

So far the spiral cam groove 70 of the rotary disk 62 has been described as being connected between its ends by the radial groove 71, but it is to be understood that if a manual operation mechanism is not provided, the radial groove 71 may be eliminated as shown in FIG. 16. Furthermore, the ridge or snap-action producing member 85 in the radial groove 71 may be eliminated as shown in FIG. 17, and instead the lock lever may be provided with a snap-action imparting means such as an over-center spring.

Figure 18:
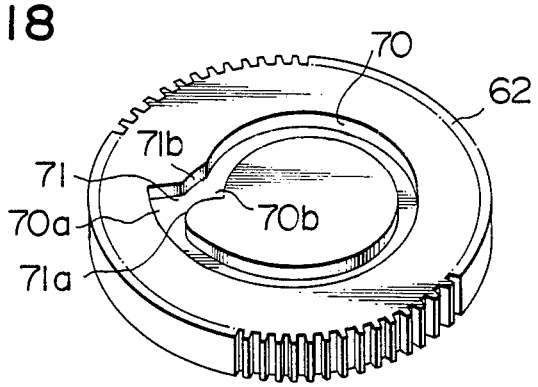

In a further modification as shown in FIG. 18, both ends of the radial groove 71 are chamfered or rounded as indicated by 71*a* and 71*b*. If the radial groove 71 has no rounded portion as indicated in FIG. 17, the cam follower 76 cannot be brought to the inner end 70*b* or the outer end 70*a* should the cam follower 76 be stopped at a midpoint between them. But when the ends of the radial groove 71 are rounded as shown in FIG. 18, the cam follower 76 can smoothly pass past such a rounded portion 71*a* or 71*b* and be brought to the end 70*b* or the end 70*a*. The ends 71*a* and 71*b* of the radial groove 71 must not be chamfered to such an extent that the cam follower 76 will not be able to make abutting contact with the side walls of such portions 71*a* and 71*b* at the end of rotation of the rotary disk 62.

So far the locking device has been described as being switched between the locking position and the unlocking position by means of the lock lever 31, but it is to be understood that any other suitable means mav be employed instead of the lock lever 31. Therefore any other suitable means which can accomplish the same function as the lock lever 31 will be referred to as "a lock member" in the claims.

Instead of the rotary disk 62 any other suitable rotary member which is not in the form of a disk may be employed. Furthermore, instead of the cam groove 70, any other suitable means which functions as a cam may be employed.

Figure 19:
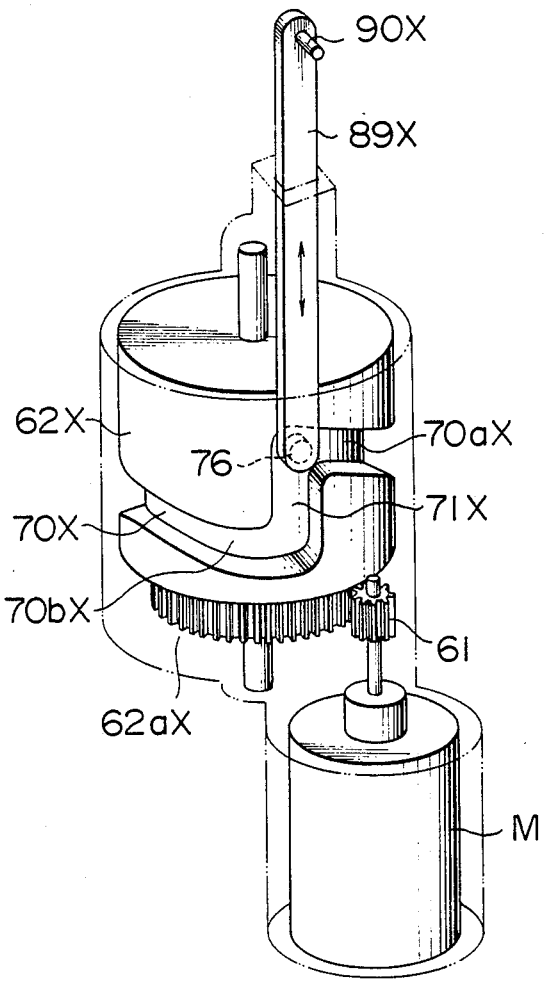
FIG. 19 shows a further modification in which instead of the rotary disk a rotary cylinder or cylindrical cam is used.

In FIG. 19 instead of the rotary disk 62, a rotary cylinder or cylindrical cam 62X is used. The underlying principle of this arrangement is substantially similar to that described hereinbefore with reference to FIG. 14 so that those parts corresponding to the parts shown in FIG. 14 are designated by the same numerals with a suffix X.

The rotary cylinder or cylindrical cam 62X is formed with a cam groove 70X and a vertical or axial groove 71X is formed to interconnect the ends 70*a*X and 70*b*X of the cam groove 70X. The rotation of the motor M is transmitted through the pinion 61 to the external teeth 62*a*X, whereby the rotary cylinder or cylindrical cam 62X is rotated. As a result, a follower lever 89X which carries the cam follower 76 is displaced in the directions indicated by the double-pointed arrow; that is, in the direction parallel to the axis of the rotary cylinder or cylindrical cam 62X.

If required, a cam groove may be so designed and constructed that the cam follower 76 is displaced not only in the radial direction but also in the axial direction.

Referring next to FIGS. 20 through 31, a second embodiment of the present invention will be described. First referring to FIGS. 20 and 21, a motor M which is housed in a casing 103 drives a lock lever 100 between the locking and unlocking positions. The output shaft of the motor M carries a pinion 104*a* in mesh with a gear 104*b*. A pinion 104*c* which is disposed integral and coaxial with the gear 104*b* is in mesh with the external teeth 105*a* of a rotary disk 105. The rotary disk 105 is housed in a casing 106 and is adapted to rotate about the axis thereof.

Figure 21:
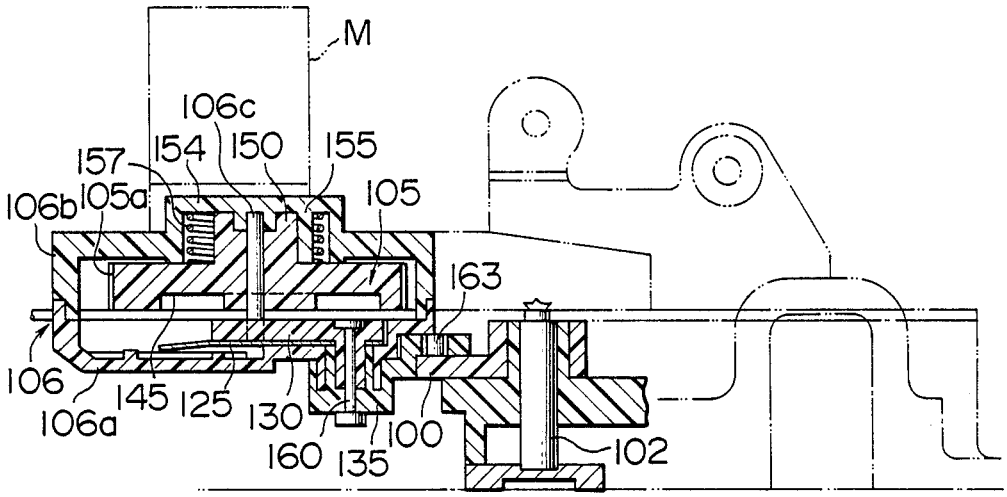
FIG. 21 is a fragmentary longitudinal section as viewed from the right of FIG. 20.
Figure 22:
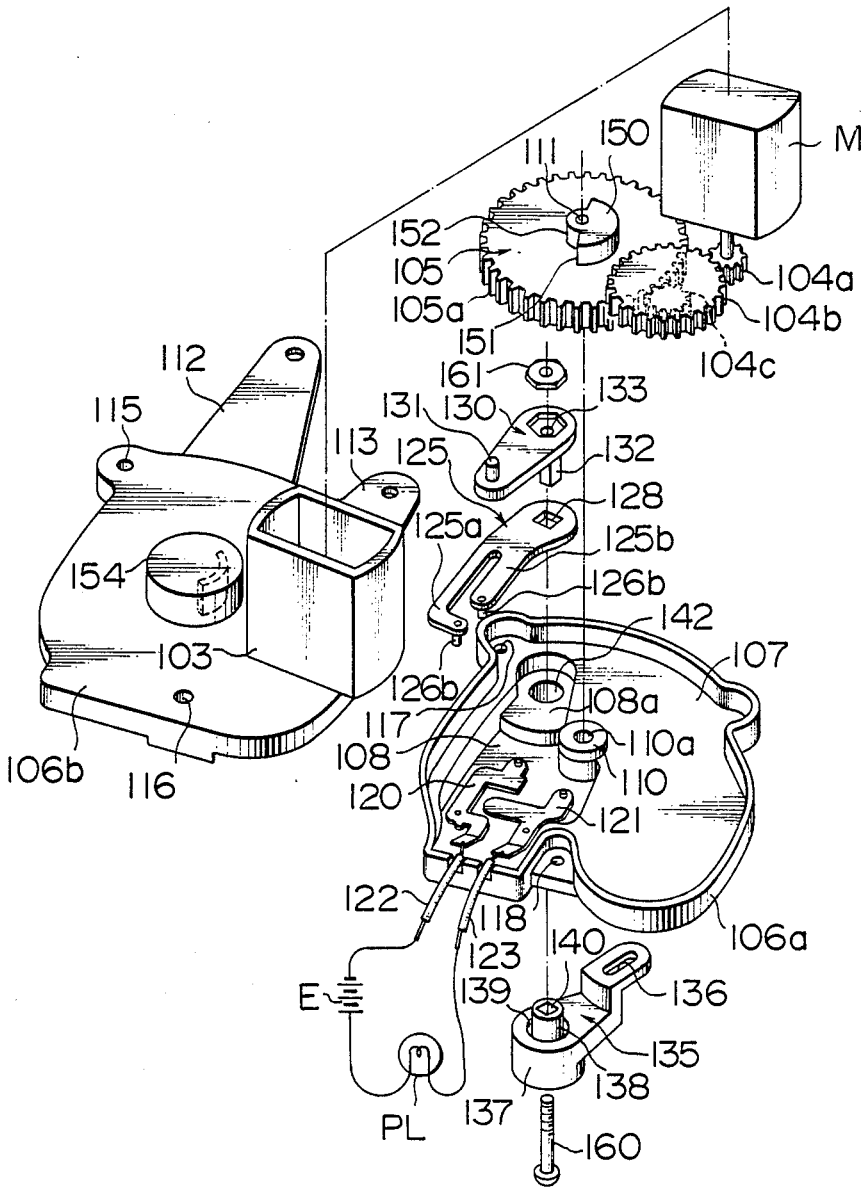
FIG. 22 is an exploded perspective view of the second embodiment of the invention as shown in FIG. 20.

FIG. 22 shows in detail a power operating mechanism including the motor M. The casing 106 comprises a main body 106*a* and a cover 106*b* both of which are made of an electrically insulating material. The main body 106*b* has a bottom wall 107 which is formed with a recess 108 and a short cylindrical seat 110 for rotatably receiving thereon the rotary disk 105. The seat 110 is formed with an axial hole 110*a*. When the cover 106*b* is placed over the main body 106*a* so as to close the rotary disk 105, a shaft 106*c* (See FIG. 21) which is extended from the inner wall of the cover 106*b* is passed through a center hole 111 (See FIG. 22) of the rotary disk 105 and fitted into the axial hole 110*a* of the seat 110, whereby the rotary disk 105 can freely rotate about the shaft 106*c*.

Figure 20:
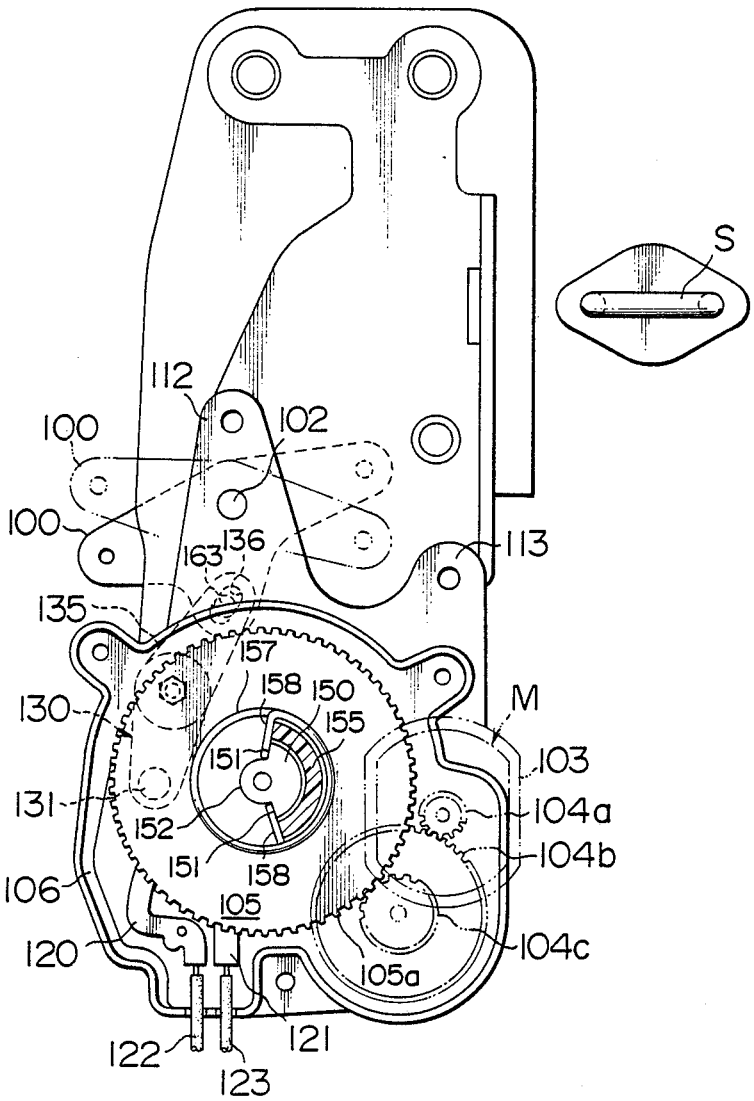
FIG. 20 is a front view of a second embodiment of the present invention.

The outer surface of the cover 106*b* is formed integral with the casing 103 into which is housed the motor M. As shown in FIG. 20, brackets 112 and 113 are extended from the cover 106*b* and securely fixed to the main body of the locking device. The cover 106*b* is formed with screw holes 115 and 116 which mate with screw holes 117 and 118, respectively, of the main body 106*a*, and the main body 106*a* and the cover 106*b* are assembled by passing screws into these holes and tightening the same.

A pair of conductors 120 and 121 are securely disposed in the recess 108 of the main body 106*a* and are connected to wires 122 and 123, respectively, which in turn are connected in series to a pilot lamp PL and a power source E.

In order to interconnect and disconnect between the conductor pair 120 and 121, a movable contact 125 made of a leaf spring is provided. The contact 125 has an L-shaped arm 125*a* and a straight and short arm 125*b* and projections 126*a* and 126*b* are extended from the extreme ends of these arms, respectively. The contact has also a square hole 128 adjacent to its base portion.

An internal rotary lever 130 has a cam follower 131 which is in the form of a pin and projects from one end thereof, and a spare shaft 132 extends from the other end thereof. A through hole 133 is formed through the square shaft 132.

Figure 23:
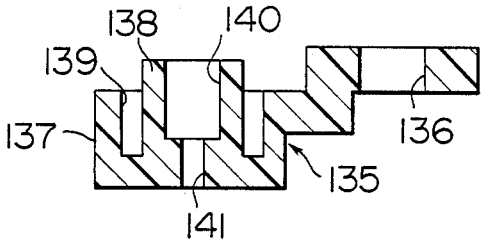
FIG. 23 is a sectional view of an external rotary lever.

An external rotary lever 135 has an elongated slot 136 formed adjacent to one end thereof, and the other end of the lever 135 has a cylindrical portion 137 in which is formed a coaxial boss 138 with an annular groove 139 interposed therebetween. The boss 138 has a square hole 140 into which the square shaft 132 of the internal rotary lever 130 can be snugly fitted. As best shown in FIG. 23, the annular groove 139 between the boss 138 and the cylindrical portion 137 has a bottom. That is, the cylindrical portion 137 and the boss 138 are formed integral with each other. A round hole 141 is extended through the bottom wall of the square blind hole 140.

Figure 24:
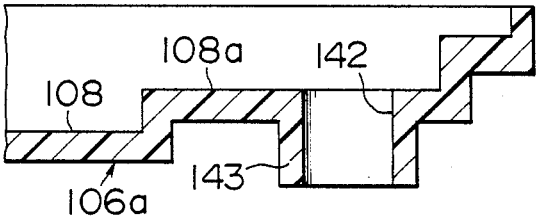
FIG. 24 is a partial sectional view of a casing main body.

The recess 108 of the case main body 106 is contiguous with a raised portion 108*a* which is formed with a hole 142, which extends through a cylindrical portion 143 extended downwardly from the case main body 106 as best shown in FIG. 24.

Figure 25:
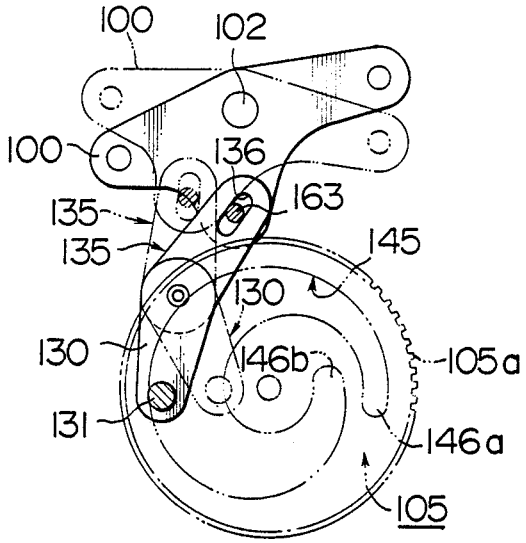
FIG. 25 is a view explanatory of a mechanism interconnecting a rotary disk and a lock lever.
Figure 26:
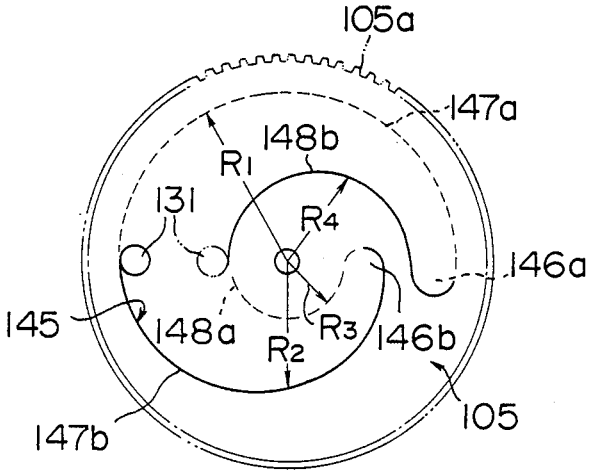
FIG. 26 is a view explanatory of a cam groove formed in the rotary disk.

As best shown in FIG. 25, which is a top view of the rotary disk 105, the undersurface of the disk 105 is formed with a cam groove 145 in the form of a spiral. The cam groove 145 has one end 146*a* and the other end 146*b* both of which are spaced apart from the center of the rotary disk 105 radially outwardly. The cam groove 145 is made widest at the midpoint between the ends 146*a* and 146*b*. As best shown in FIG. 26, the radially outer edge of the cam groove 145 is defined by a continuous curve consisting of an arc 147*a* of a circle having a radius $R_1$ (indicated by the broken lines) and subtending substantially an angle of 180°; and a spiral curve 147*b* (indicated by the solid line) having a varying radius $R_2$ gradually decreasing toward the end 146*b*. In like manner, the inner edge of the cam groove 145 is defined by a continuous curve consisting of an arc 148*a* of a circle having a radius $R_3$ (indicated by the broken lines) and subtending substantially an angle of 180°, and a spiral curve 148*b* (indicated by the solid line) having a varying radius $R_4$ gradually increasing toward the end 146*a*. The radius $R_1$ of the arc 147*a* is equal to the maximum radius $R_2$ of the spiral curve 147*b*, while the radius $R_3$ of the arc 148*a* is equal to the minimum radius $R_4$ of the spiral curve 148*b*. Furthermore, the arcs 147*a* and 148*a* are in diametrically opposed relationship, and the spiral curves 147*b* and 148*b* are also in diametrically opposed relationship.

As described above, the spiral curve 147*b* has the gradually changing radii $R_2$ with respect to the center of the rotary disk 105, and the spiral curve 148*b* has also the gradually changing radii $R_4$, so that the cam follower 131 which moves along these spiral curves of the cam groove 145 is subjected to the action to be described below. That is, these spiral edges 147*b* and 148*b* are the "action-imparting edges." On the other hand, the arcuate edges 147*a* and 148*a* are spaced apart from the center of the disk 105 by the same distances; that is, $R_1$ and $R_3$, respectively, so that they will not impart any action on the cam follower 131. Thus they are the "non-action-imparting edge". Therefore the spiral edge 147*b* gradually approaches the arcuate edge 148*a* toward the end 146*b*, and in like manner the spiral edge 148*b* gradually approaches the arcuate edge 147*a* toward the end 146*a*. It is to be noted that the arcuate edge 147*a* is smoothly merged with the spiral edge 147*b* substantially at the midpoint between the ends 146*a* and 146*b* of the cam groove 145, and in like manner the arcuate edge 148*a* is smoothly merged with the spiral edge 148*b* substantially at the midpoint between the ends 146*a* and 146*b*.

Referring back to FIG. 22, a segment-shaped projection 150 is extended axially outwardly from the upper surface of the rotary disk 105 and has two end faces 151, and a semicylindrical projection 152 is formed integral and coaxial with the segment-shaped projection 150. The hole 111 is extended through the semicylindrical projection as best shown in FIG. 27.

Figure 27:
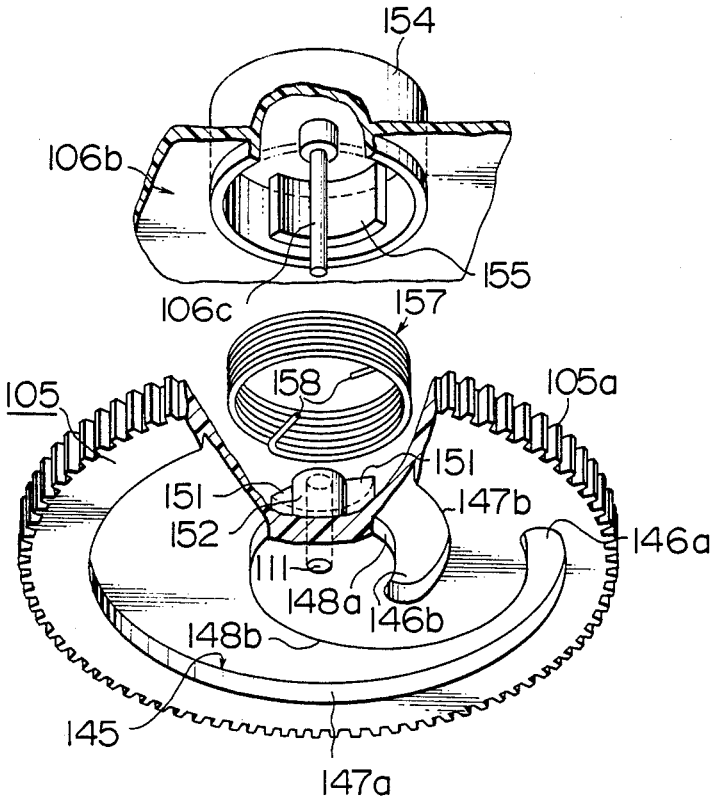
FIG. 27 is an exploded perspective view showing a mechanism for returning the rotary disk to its neutral position.

Referring to FIGS. 22 and 27, a hollow cylindrical projection 154 with a top is extended upright from the case cover 106*b* in substantially coaxial relationship therewith, and the shaft 106*c* is extended downward from the top of the cylindrical projection 154 in substantially coaxial relationship therewith. An arcuate depending wall 155 is extended downwardly from the top of the hollow cylindrical projection 154 in substantially in coaxial relationship with the shaft 106*c*. As best shown in FIG. 20, when the cover 106*b* and the main body 106*a* are assembled, the arcuate wall 155 is disposed radially outwardly of the segment-shaped projection 150 in opposed relationship therewith and spaced apart therefrom by a suitable distance, the arcuate length of the arcuate wall 155 being substantially equal to the arc length of the segment-shaped projection 150.

Still referring to FIG. 27, a coiled spring 157 is disposed within the hollow cylindrical projection 154 in such a way that the coiled spring 157 surrounds the segment-shaped projection 150 and the arcuate depending wall 155. The two ends 158 of the coiled spring 157 are bent radially inwardly and engaged with the end faces 151, respectively, of the segment-shaped projection 150 as best shown in FIG. 20.

Figure 28:
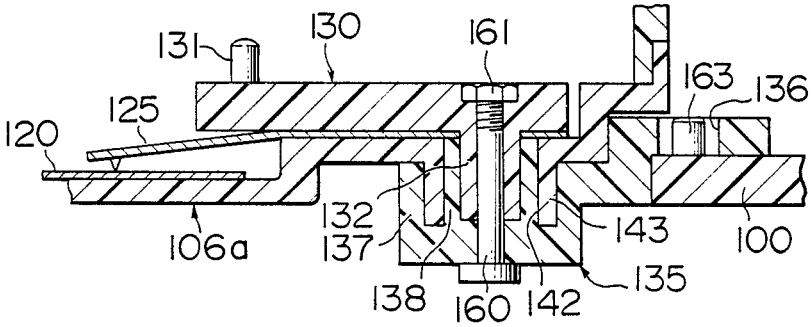
FIG. 28 is a sectional view showing the positional relationship between the internal and external rotary levers in the casing main body.

Next the assembly of the above-described parts will be described in more detail below. First the conductors 120 and 121 are disposed in the recess 108 of the main body 106*a* as shown in FIG. 22 and thereafter the boss 138 of the external rotary lever 135 is inserted into the hole 142 of the raised portion 108*a* as shown in FIG. 28. Next the square shaft 132 of the internal rotary lever 130 is fitted into the mating square hole 128 of the contact member 125 and then into the square hole 140 of the boss 138 of the external rotary lever 135. Thereafter a bolt 160 (FIG. 22) is inserted into the round hole 141 (FIG. 23) of the external rotary lever 135 and passed through and beyond the hole 133 of the square shaft 132 and is engaged with a nut 161 as best shown in FIG. 28. Under these conditions, the cylindrical portion 137 of the external rotary lever 135 is snugly fitted within the cylindrical wall 143 of the main body 106*a*. As a result, the interior of the main body 106*a* is completely sealed from the exterior, and the internal and external rotary levers 130 and 135 are assembled as a unitary structure because the square shaft 132 of the internal rotary lever 130 is snugly fitted into the square hole 140 of the external rotary lever 135. The boss 138 and the cylindrical portion 137 of the external rotary lever 135 are brought into close contact with the inner and outer wall surfaces, respectively, of the cylindrical wall 143 of the main body 106*a*.

Thereafter the rotary disk 105 is inserted into the main body 106*a* in such a way that the cam follower or pin 131 of the internal rotary lever 130 may engage with the cam groove 145 of the rotary disk 105, and thereafter the gear 104*b* is mounted in such a way that the pinion 104*c* meshes with the external teeth 105*a* of the rotary disk 105. Next the pinion 104*a* carried by the output shaft of the motor M is brought into engagement with the gear 104*b* as the cover 106*b* together with the motor M is placed over the main body 106*a*. The cover 106*b* is securely fixed to the main body 106*a* with the screws. Next the brackets 112 and 113 of the cover 106*b* are securely fixed to the main body of the locking device as best shown in FIG. 20. Thus the assembly is completed as shown in FIGS. 20 and 21.

When assembled, the exterior rotary lever 135 is disposed outside of the casing 106 as best shown in FIG. 21, and a pin 163 of the lock lever 100 is fitted into the elongated slot 136 of the exterior rotary lever 135 as best shown in FIG. 28. The lock lever 100 is pivoted by a pivot pin 102 as shown in FIG. 21.

The relationships among the cam groove 145 of the rotary disk 105, the internal rotary lever 130 having the cam follower 131 which is fitted into the cam groove 145, the exterior rotary lever 135 and the lock lever 100 are best shown in FIG. 25. When the internal rotary lever 130 is located at the position indicated by the solid line, the cam follower 131 engages with the outer edge 147*a* and 147*b* of the cam groove 145 as shown in FIG. 26, and the external rotary lever 135 is located at the position indicated by the solid line in FIG. 25. As a result, the lock lever 100 whose pin 163 is fitted in the elongated slot 136 of the external rotary lever 135 is located at the position indicated by the solid line.

On the other hand, when the internal rotary lever 130 is located at the position indicated by the chain line in FIG. 25, the cam follower 131 engages with the inner edge 148*a* and 148*b* of the cam groove 145 as shown in FIG. 26, so that the lock lever 100 is shifted through the external rotary lever 135 to the locking position indicated by the chain line in FIG. 25. The lock lever 100 is subjected to the force of an overcenter spring (not shown) so that it is held in the position indicated by the solid line or the position indicated by the chain line under the force of the over-center spring and is prevented from holding a position intermediate between these extreme positions. Therefore the cam follower 131 is pressed against the outer edge 147*a* and 147*b* or the inner edge 148*a* and 148*b* of the cam groove 145 under the force of the overcenter spring.

To switch to the locking condition from the unlocking condition in which the cam follower 131 is pressed against the outer edge of the cam groove 145 as indicated by the solid line in FIG. 26, the motor M is energized so as to rotate the rotary disk in the clockwise direction. Since the spiral edge 147*b* winds itself to the center of the rotary disk 105, the cam follower 131 is gradually shifted radially inwardly as the rotary disk 105 is rotated against the force of the coiled spring 157. More particularly, as the rotary disk 105 is rotated, the segment-shaped projection 150 thereof is rotated in unison so that one end face 151 thereof which engages with one end 158 of the coiled spring 157 is moved in the direction in which the coiled spring 157 is compressed or wound. In this case, the shifting of the other end 158 of the coiled spring 157 is prevented by the other end face 151 of the arcuate depending wall 155.

When the rotary disk 105 is caused to rotate against the force of the coiled spring 157 in the manner described above, the cam follower 131 is gradually shifted radially inwardly by the spiral edge 147*b* or the action-imparting edge of the cam groove 145 and reaches a dead point; that is, an intermediate point between the two extreme positions of the cam follower 131. Then, under the force of the over-center spring, the cam follower 131 is suddenly snapped to move further radially inwardly so as to engage with the inner edge 148*a* of the cam groove 145. That is, the cam follower 131 is finally brought to the position indicated by the chain line in FIG. 26 so that the internal rotary lever 130, the external rotary lever 135 and the lock lever 100 are brought to the locking positions as indicated by the chain lines in FIG. 25.

As soon as the lock lever 100 has been switched from the unlocking position to the locking position in the manner described above, the motor M is deenergized so that the rotary disk 105 is returned to its neutral position as shown in FIG. 26 under the force of the coiled spring 157. Therefore, in order to switch the lock lever 100 from its unlocking position to its locking position, the rotary disk 105 is rotated through 180° at the maximum.

In order to switch the lock lever 100 from its locking position as indicated by the chain line to the unlocking position as indicated by the solid line, the motor M is rotated in the opposite direction so that the rotary disk 105 is caused to rotate from its neutral position (See FIG. 26) in the counterclockwise direction against the force of the coiled spring 157. Then the cam follower 131 is moved along the spiral edge 148*b* or the action-imparting edge of the cam groove 145. As the spiral edge 148*b* winds itself out of the center of the rotary disk 105, the cam follower 131 is moved radially outwardly. When the cam follower 131 reaches and passes past the dead point, it is suddenly snapped toward the outer edge 147*a* of the cam groove 145. Then the motor M is de-energized and the rotary disk 105 is returned to its neutral position under the force of the coiled spring 157. As a result, the cam follower 131 is brought to and held at the unlocking position as indicated by the solid line in FIG. 26. The lock lever 100 is also returned to the unlocking position as indicated by the solid line in FIG. 25. In this case, the maximum angle of rotation of the rotary disk 105 is also 180°. Thus the lock lever 100 can be shifted between the locking and unlocking positions by energizing the motor M.

In the case of the manual operation, force is exerted on the lock lever 100 through a suitable mechanism (not shown). The rotation of the lock lever 100 is transmitted through the external rotary lever 135 to the internal rotary lever 130 so that the cam follower 131 is displaced only in the widest intermediate portion of the cam groove 145. However, the rotary disk 105 remains stationary. That is, the manual operation will not affect the driving mechanism. As described above, the lock lever 100 is loaded with the over-center spring as described hereinbefore so that the snap action may be imparted to the lock lever 100. As described with particular reference to FIG. 11, the cam follower 131 fitted in the cam groove 145 of the rotary disk 105 of the driving mechanism is subjected to the wedge action so that the output force can be considerably increased, and consequently the force to be produced by the motor M for overcoming the force of the over-center spring can be reduced.

Figure 29:
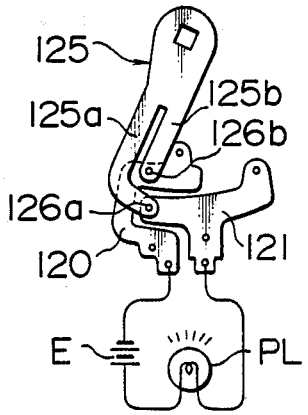
FIG. 29 shows an electric circuit which turns on a pilot lamp giving a warning that a door is left unlocked.
Figure 30:
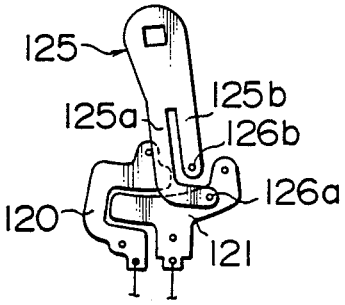
FIG. 30 is a view similar to FIG. 11 showing that the pilot lamp is turned off as the door is locked.

In unison with the swinging motion of the internal and external rotary levers 130 and 135 between the locking and unlocking positions, the contact member 125 is also rotated between the locking and unlocking positions. In the unlocking position as shown in FIG. 29, the projections 126*a* and 126*b* of the arms 125*a* and 125*b* of the contact member 125 are brought into contact with the conductors 121 and 120, respectively, so that an electric circuit is established and consequently the pilot lamp PL is lit, giving the warning that the door is not locked. Therefore when the motor M is energized so that the lock lever 100 is shifted to the locking position, the contact arm 125*b* is separated from the conductor 120 so that the electric circuit is broken and consequently the pilot lamp PL is turned off indicating that the door is locked.

The cam groove profile of the second embodiment of the invention has the following advantages. That is, the rotary disk 105 normally holds the neutral position in which the cam follower 131 is positioned at the widest portion of the cam groove 145. Therefore the cam follower 131 is prevented from being caught by the cam groove 145, and, consequently, even in the case of failure of the motor M and its associated electrical systems, manual operation is always possible. In addition, the cam follower 131 engages only with one edge of the cam groove 145 so that it encounters less frictional force. Moreover it is not necessary to rotate the rotary disk through 360° and it is only necessary to rotate it through 180°.

As described before, the cam groove 145 has the non-action-imparting edges or arcuate edges 147*a* and 148*a* with constant radii $R_1$ and $R_3$, respectively, so that when the rotary disk 105 is returned to its neutral position after it has brought the cam follower 131 to the locking position or the unlocking position, the arcuate edges 147*a* and 148*a* will not impart any force on the cam follower 131, and consequently the cam follower 131 encounters less frictional force.

Figure 31:
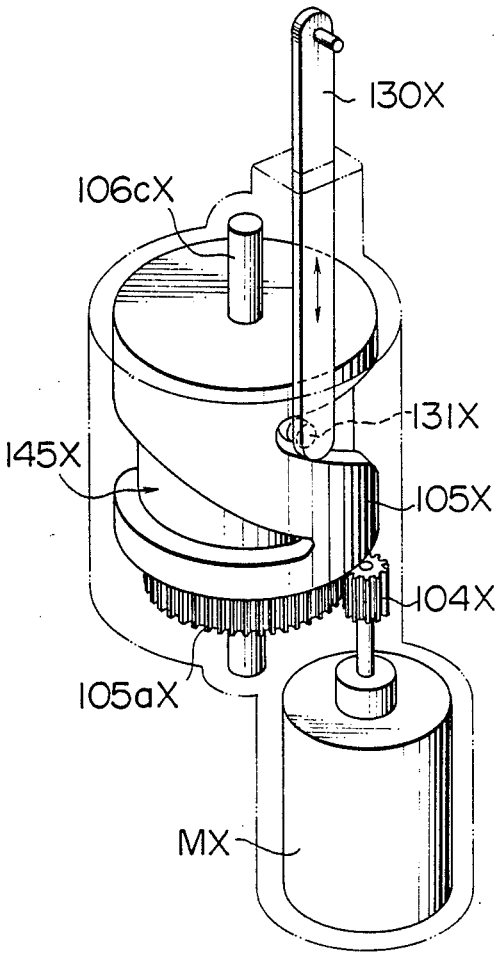
FIG. 31 shows a modification of the second embodiment in which instead of the rotary disk a cylindrical cam is used.

As in the case of the modification described before with reference to FIG. 19, instead of the rotary disk 105, the second embodiment may also employ a cylinder or cylindrical cam 105X as shown in FIG. 31. A pinion 104X of a motor MX is in mesh with the external teeth 105*a*X formed integral with the cylinder or cylindrical cam 105X so that as the motor MX is driven, the cylinder or cylindrical cam 105X is caused to rotate about a shaft 106*c*X. A cam groove 145X is defined in a manner substantially similar to that described above with reference to the cam groove 145 as best shown in FIG. 26. A cam follower 131X is fitted into the cam groove 145X and the displacement of the cam follower 131X in the axial direction (the vertical direction in FIG. 31) is transmitted to the lock lever 100 through a link 130X. The link 130X is loaded with an over-center spring (not shown) which biases the cam follower 131X so as to be pressed against either of the upper or lower edge of the cam groove 145X. The cylinder or cylindrical cam 105X is also loaded with a bias spring (not shown) so that it is normally held in its neutral position.

The non-action-imparting edges of the cam grooves 145X are located in planes perpendicular to the axis of the cylinder or cylindrical cam 105X and are in parallel with the top or bottom of the cylinder or cylindrical cam 105X. Therefore, as long as the cam follower 131X is brought into contact with the upper or lower non-action-imparting edge of the cam groove 145X, the axial displacement of the cam follower 131X will not occur. On the other hand, the action-imparting or spiral edges are gradually spaced apart from the opposing non-action-imparting or arcuate edges in the axial direction. Therefore the cam follower 131X which is in contact with the action-imparting or spiral edge is caused to displace itself axially upwardly or downwardly.

It is to be understood that the present invention may be equally applied not only to the doors but also to headlamps with a cover and roof vents of automobiles and also to locking devices for other than automobiles.

What is claimed is:

1. A locking device of the type comprising: latch means; a lock member movable between a locking position, in which said locking device is caused to assume a locking condition to prevent the latch means from being released, and an unlocking position, in which said locking device is caused to assume an unlocking condition allowing the latch means to be released; and a powered operating means for causing said locking member to move between said locking position and said unlocking position; said powered operating means comprising:

a rotary member coupled to driving means so as to be rotated in either direction, said rotary member having on the surface thereof a cam groove which extends around the axis of rotation of the rotary member and has a first end and a second end which are spaced apart from each other by a suitable distance in at least one of the radial and axial directions of the rotary member, said rotary member also having a connecting cam groove interconnecting said first end and second end of said cam groove;

a cam follower slidably engaged with said cam groove of the rotary member, rotation of the rotary member by the driving means causing the cam follower to be shifted by said suitable distance; and means for operatively connecting the cam follower to said lock member in such a manner that when the cam follower is at said first end of the cam groove the lock member takes the locking position, and when the cam follower is at said second end of the cam groove the lock member takes the unlocking position;

the lock member being movable manually between the locking and unlocking positions, said connecting cam groove allowing the cam follower to move directly between said first and second ends of the cam groove when the lock member is caused to move manually between the locking and unlocking positions.

2. A locking device as set forth in claim 1 wherein said means for operatively connecting the cam follower to the lock member is linkage means.

3. A locking device as set forth in claim 1 wherein said means for operatively connecting the cam follower to the lock member is an arm integrally extending from the lock member.

4. A locking device as set forth in claim 1 wherein a ridge or hump means adapted to impart a snap action to said cam follower is disposed in said connecting cam groove, whereby the cam follower is prevented from being stopped or caught in said connecting cam groove except at said first or second end of the cam groove.

5. A locking device as set forth in claim 1 wherein the rotary member is a disk rotatable around said axis of rotation and the cam groove is provided in the surface of the disk extending perpendicular to the axis of rotation.

6. A locking device as set forth in claim 4 wherein the rotary member is a cylindrical member having its longitudinal axis as the axis of rotation and the cam groove is provided in the cylindrical surface thereof.

7. A locking device as set forth in claim 4 wherein said cam follower is provided with a bias spring so that when the cam follower rides over said ridge or hump means in said connecting cam groove it is retracted in the axial direction thereof.

8. A locking device as set forth in claim 6 wherein said ridge or hump means is provided with a bias spring so that when the cam follower rides over said ridge or hump means in said connecting cam groove, said ridge or hump means is retracted so as to permit the smooth passage of the cam follower through the connecting cam groove.

9. A locking device of the type comprising: latch means; a lock member movable between a locking position, in which said locking device is caused to assume a locking condition to prevent the latch means from being released, and an unlocking position, in which said locking device is caused to assume an unlocking condition allowing the latch means to be released; and a powered operating means for causing said lock member to move between said locking position and said unlocking position; said powered operating means comprising:

a rotary member coupled to driving means so as to be rotated in either direction, said rotary member having in the surface thereof a cam groove which extends around the axis of rotation of the rotary member and has one end and the other end which are spaced apart from each other by a suitable distance in at least one of the radial and axial directions of the rotary member;

a cam follower slidably engaged with said cam groove of the rotary member;

means for operatively connecting the cam follower to said lock member;

said cam groove being defined between said one end and said other end by one side edge and the other side edge which is in opposed relationship with said one side edge, each of said side edges comprising a non-action-imparting side edge portion and an action-imparting side edge portion which are smoothly merged together;

said non-action-imparting side edge portion extending at a constant distance from a locus of rotation of a point on said rotary member whereby the non-action-imparting edge portion imparts no action to aid cam follower during the rotation of the rotary member, said action-imparting side edge portion extending with varying distance from said locus of rotation whereby the action-imparting side edge portion imparts an action to said cam follower so as to displace the same in the direction perpendicular to said locus of rotation, the non-action-imparting side edge portion of said one side edge of the cam groove being in opposed relationship with the action-imparting side edge portion of the other side edge while the non-action-imparting side edge portion of the other side edge is in opposed relationship with the action-imparting side edge portion of said one side edge of the cam groove, the action-imparting side edge portions of the one and other side edges being so shaped that the distance between the action-imparting side edge portions and the respective opposing non-action-imparting side edge portions being gradually decreased toward said one end and said other end;

means for biasing said rotary member so as to normally assume a neutral position in which said cam follower can be held at the midpoint between said one end and said other end of the cam groove;

said action-imparting side edge portion and said non-action-imparting side edge portion of each of the one side edge and the other side edge smoothly merging together at said midpoint between said one end and said other end of the cam groove; and over-center bias means for pressing the cam follower against said one side edge or said other side;

said cam follower and said lock member being so operatively coupled to each other that one position of the cam follower at which it is pressed against said one side edge of the cam groove at said midpoint corresponds to the locking position of the lock member while the other position of the cam follower at which it is pressed against the other side edge of the cam groove at said midpoint corresponds to the unlocking position of the lock member.

10. A locking device as set forth in claim 9 wherein said rotary member is a rotary disk, and said cam groove is formed in one major surface thereof.

11. A locking device as set forth in claim 9 wherein said rotary member is a cylinder of a predetermined axial length, and said cam groove is formed in the cylindrical surface thereof.

* * * * *